United States Patent [19]

Johnson

[11] Patent Number: 4,730,943

[45] Date of Patent: Mar. 15, 1988

[54] PLASTIC BAG WITH CARRYING HANDLE

[76] Inventor: James R. Johnson, 3819 Greenhill Dr., Chamblee, Ga. 30341

[21] Appl. No.: 928,202

[22] Filed: Nov. 7, 1986

[51] Int. Cl.[4] ..... B65D 33/10; B65D 30/00

[52] U.S. Cl. ..... 383/8; 383/120; 383/25

[58] Field of Search ..... 383/25, 6, 8, 17, 18, 383/21, 30, 120, 123; 229/52 R, 52 AL

[56] References Cited

U.S. PATENT DOCUMENTS

| | | | |
|---|---|---|---|
| 4,539,705 | 9/1985 | Baines | 383/21 |
| 4,550,439 | 10/1985 | Peppiatt et al. | 383/21 |
| 4,555,804 | 11/1985 | Cannin et al. | 383/25 |

*Primary Examiner*—Willis Little

*Attorney, Agent, or Firm*—James B. Middleton

[57] ABSTRACT

A plastic bag adapted to receive rectangular contents that will square off the bag is provided with a handle. The plastic bag is formed with a bottom gusset, and angle seals define define the width of the bag with the rectangular contents. Handle material is placed within the gusset and extended across the bag. Rectangular seals fix the handle material to the gusset, the rectangular seals being confined to the area within the angle seals. When the bag is filled, the rectangular seals result in straight lines fixing the handle to the bag so forces are evenly distributed across the seal.

11 Claims, 6 Drawing Figures

PLASTIC BAG WITH CARRYING HANDLE

INFORMATION DISCLOSURE STATEMENT

It is known in the industry to provide a plastic bag having a bottom gusset, the bag being arranged to be filled and sealed, and inverted so that the gussetted bottom becomes the top of the container as merchandised. It is also known, in combination with such plastic bags, to provide a carrying strap or handle sealed into the gusset.

One form of handle, or carrying strap, is shown in British Pat. No. 1,022,595, filed in 1963. This patent discloses the provision of a bottom gussetted plastic bag, with a folded piece of material placed into the bottom gusset, and sealed into the side seams of the bag. A similar bag is shown in U.S. Pat. No. 3,370,630 issued to Haugh et al.

A more recent form of carrying strap is shown in U.S. Pat. No. 4,539,705 wherein the handle material is sealed into the bag along with the angle seals that provide the gusset. Similarly, U.S. Pat. No. 4,550,439 discloses folded handle material placed into the bottom gusset of a bag, and a triangular surface sealed to provide both angle seals for the gusset and seals to hold the carrying handle, or handle material, in position.

In the earlier form of carrying handle wherein the handle material is attached to the bag only by being sealed into side seams of the bag, it will be understood that stress is concentrated at the lowest point in the seal, with slight distribution of the force along the portion of the side seam that includes the handle material. Such an arrangement can result in poorly attached handles, and can of course allow holes to be pulled in the side seam of the bag.

The form of carrying handle wherein the handle material is sealed to the bag by angle seams or areas still provides a concentrated force at the lowermost point along the side seam of the bag. While the angle seals provide some distribution of the force, the concentrated force at the one point can still result in torn handles, and holes in the side panels of the bag.

SUMMARY OF THE INVENTION

This invention relates generally to plastic bags, and is more particularly concerned with a carrying strap for a bottom gussetted plastic bag that will be generally rectangular when filled.

The present invention provides a plastic bag having a bottom gusset, and angle seals to allow the bag to square off when the bag is filled with generally rectangular contents. Handle material is placed into the bottom gusset after the angle seals have been provided, and the handle material is sealed to the bottom gussets with block seals having generally rectangular shapes. The seals are within the confines of the angle seals, and are centered on the line that will be the side seam of the bag. Thus, the seals for the handle material will be substantially centered on the side panels of the completed bag. The carrying strap will tend to be held snugly against the package after filling; and, the forces exerted by the carrying strap on the side panels of the bag will be substantially uniformly distributed along a generally straight line.

In accordance with the present invention, the handle material may be heat sealed to the bag material, or the handle material may be fixed by adhesives or the like. Also, the present invention contemplates a very narrow handle that will be easy to grasp, but also includes a very wide handle that may optionally be provided with a plurality of openings for use as finger holes for easy gripping.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
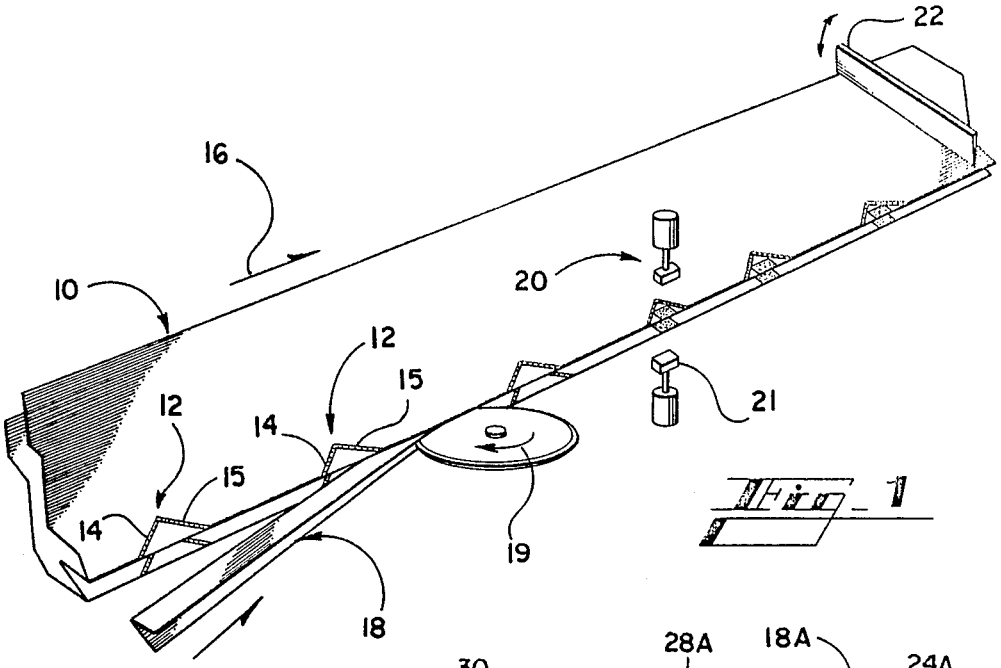
FIG. 1 is a somewhat schematic perspective view showing apparatus for producing bags in accordance with the present invention.

Referring now more particularly to the drawings, and to those embodiments of the invention here presented by way of illustration, FIG. 1 shows a strip of bag material generally designated at 10. Those skilled in the art will understand that it is conventional to provide a wide strip of material, and to fold the material along its centerline to provide basic bag material. The bottom gusset 11 is then provided by folding the folded edge inwardly. These techniques are well known in the art, so no detailed discussion is required.

To provide a bottom gussetted bag, it is known in the art to place a pair of angle seals in the bottom gusset 11. These seals are here indicated at 12, and it will be understood that the apexes of the angle seals 12 will be the division between two adjacent bags. Thus, the line 14 of the angle seal 12 will be at one edge of one bag, while the line 15 of the same angle seal 12 will be at the opposite edge of the adjacent bag. These angle seals are well known in the art, and can be provided by many forms of conventional equipment. One example of angle sealers is shown in U.S. application Ser. No. 849,054 by James R. Johnson, filed Apr. 7, 1986, U.S. Pat. No. 4,692,135 issued Sept. 8, 1987. The disclosure in that application is incorporated herein by reference.

As the bag material 10 moves along its path as designated by the arrow 16, a strip of handle material 18 is inserted into the gusset 11. Those skilled in the art will understand that conventional handle material 18 comprises simply a strip of plastic material folded about its center line. The handle material 18 is moved towards the bag material 10, and is tucked into the gusset 11 by a tucking means here shown as a tucking disk 19.

Once the handle material 18 has been appropriately placed within the gusset 11, the handle material 18 is sealed to the two sides of the gusset. The sealing means is here indicated at 20 and 21. Again, arrangements such as that disclosed in the above mentioned U.S. Pat. No. 4,692,135 can be used, substituting larger blocks for the line sealers. After the sealing means 20 and 21, the bag material 10 continues to move until the bags are individually sealed and separated by the side sealer blade 22. As is conventional, the blade 22 will seal a line across the bag material 10, and will separate an individual bag from the strip of bag material 10.

Figure 2:
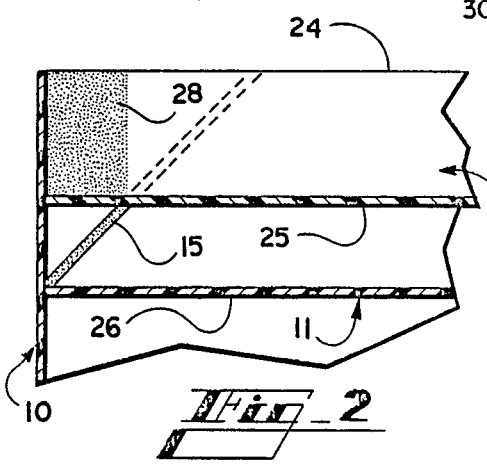
FIGS. 2, 3 and 4 are enlarged cross-sectional views showing three different ways to position and to seal the handle material into the bottom gusset; and, FIGS. 5 and 6 are perspective views, partially broken away, showing completed bags made in accordance with the present invention, the two figures showing two different handle materials.

Looking next at FIG. 2 of the drawings, it should first be understood that FIG. 2 illustrates a bag after the bag has been completed as was discussed in conjunction with FIG. 1, the bag being laid flat, then cut between the two side walls. Thus, the gusset 11 is cut in half, and the handle material 18 is cut in half. One angle seal 15 is shown, and a half of the block seal for the handle material 18 is shown.

In FIG. 2 it will be seen that the handle material 18 is relatively narrow, but the upper edge 24 of the handle material is substantially aligned with the upper edge of the gusset 11. The folded edge 25 of the handle material is displaced upwardly from the innermost edge 26 of the gusset 11.

FIG. 2 illustrates the sealed area 28, and it will be seen that the sealed area 28 is within the triangular area in the corner of the bag defined by the angle seal 15. In the embodiment of the invention shown in FIG. 2 of the drawings, the sealed area 28 extends substantially to the edge 25 of the handle material, but does not cross the angle seal 15. If the block seal crosses the angle seal 15, stresses will be placed on the corners when the bag is filled and squared off.

Figure 3:
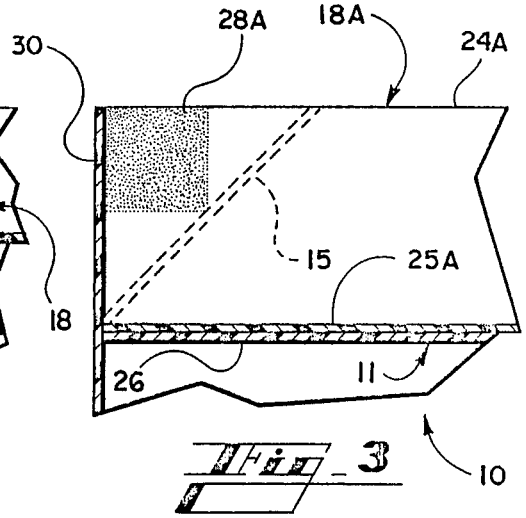

Looking at FIG. 3 of the drawings, the figure is substantially the same as FIG. 2, but the handle material is different. Thus, the same reference numerals are used for the bag, but the same numerals with an A suffix are used for the handle material. The handle material 18A has substantially the same width, or depth, as the gusset 11. As a result the lowermost edge 26 of the gusset is substantially engaged by the lowermost edge 25A of the handle material 18A. Because the handle material 18A substantially covers the gusset 11, the angle seal 15A is hidden and is indicated in broken lines.

In the embodiment of the invention shown in FIG. 3, if the sealed area 28 were to extend to the fold line 25A of the handle material 18A, it will be seen that the sealed area would be infinitely narrow, or would cross the angle seals 15. The proper technique in accordance with the present invention is to seal an area at the upper edge of the gusset 11, and to allow the lower edge of the handle material 18A to remain unsealed. It will be understood that there will be a line twice the length of the seal 28A, since the sealed area 28A will extend through the side weld 30 and to the opposite side of the bag. While the handle material 18A will become sealed in the side seal 30, slight force will tear that portion loose, so the weight of the package will then be carried by the sealed area 28A.

Figure 4:
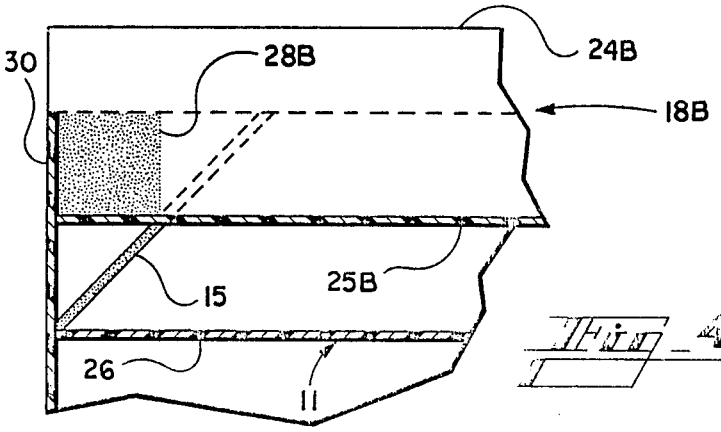

Looking now at FIG. 4 of the drawings, the bag is again designated by the same numerals, with the handle material designated with numerals with a B suffix. In FIG. 4 it will be seen that the handle material 18B is relatively wide, but is not placed entirely into the gusset 11. Thus, the lowermost, folded, edge 25B is spaced upwardly from the gusset fold 26, and the upper edge 24B extends beyond the gusset 11. As before, the angle seal 15 is shown, and the sealed area 28B extends substantially to the bottom edge 25B of the handle material 18B, and does not cross the angle seal 15.

With the above description in mind, it should be understood that the carrying strap of the present invention is fixed into a bottom gussetted bag, the bag being substantially filled with material having a rectangular shape, the bag is sealed at its open end, and the package is inverted so the carrying strap is now on the top of the package.

Figure 5:
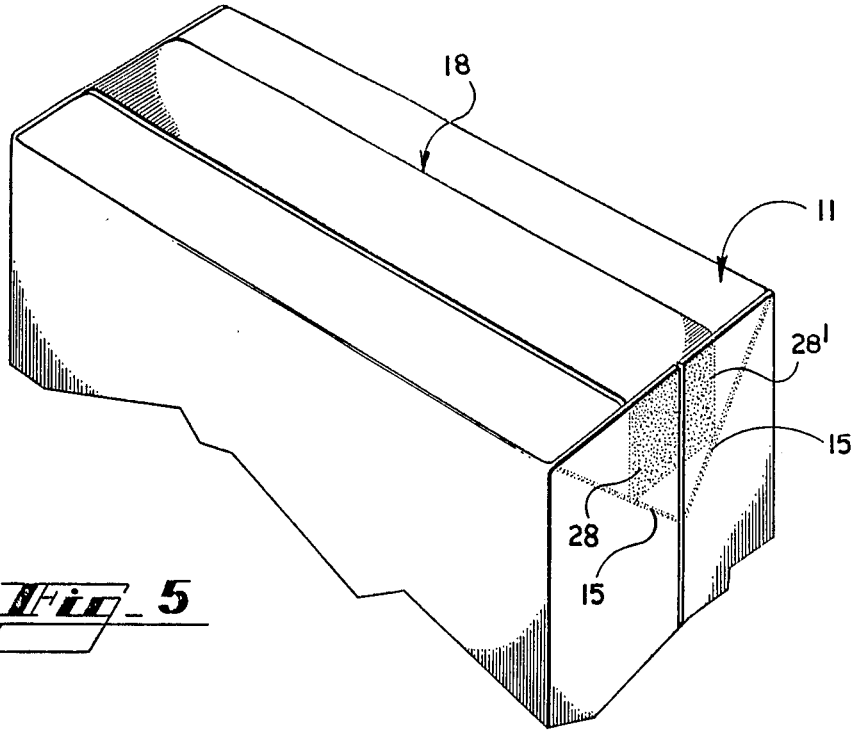

Looking at FIG. 5 of the drawings, it will be seen that the bag generally designated at 31 has been filled with rectangular contents so that the package is squared off. The angled seals 15 define the natural width of the bag, and the gusset forms the bottom of the bag, here designated at 11 since the bottom of the bag is the same as the gusset 11 shown in previously discussed figures.

The sealed areas 28 and 28′ are the block seals as discussed above. In FIG. 5 it will be seen that the package is opened out so that the two seals 28 and 28′ provide a sealed rectangle within the confines of the angle seals 15.

It should also be understood by those skilled in the art that the handle material 18 is placed into the gusset 11 while the material is flat. When the bag is squared off as is shown in FIG. 5, it will be understood that the handle material 18 is forced to take a somewhat longer path because of the expansion of the gusset 11. The result is that the handle is urged very snugly against the container 31. When the handle 18 is used, it will be seen that forces will be on the sealed areas 28 and 28′, and this defines generally a horizontal, straight line. Thus, the force will be uniformly distributed along the straight line for maximum strength of the handle.

Also, still looking at FIG. 5 of the drawings, it will be seen that a narrow handle 18 can be extended downwardly between the angle seals 15 for greater insertion, while a wider handle cannot be extended down as far. In either case the sealed areas remain within the confines of the angle seals 15, and the width of the sealed area varies.

Figure 6:
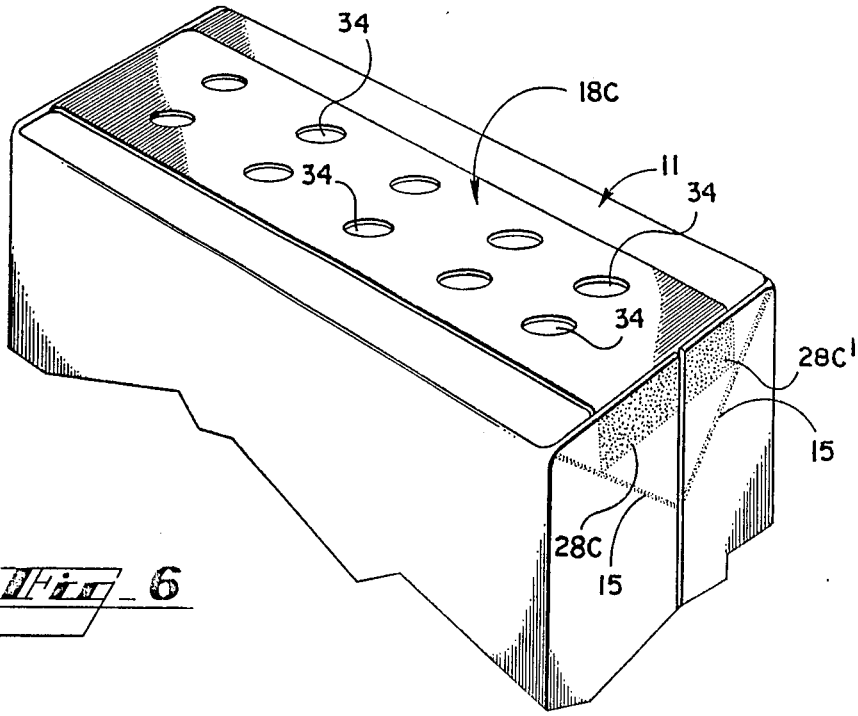

Looking at FIG. 6 of the drawings, a bag 31A is shown, the bag 31A being the same as bag 31 except that the handle material 18C is somewhat different. The handle material 18C is wide relative to the bottom 11 of the package 31A. As a result, the sealed areas 28C and 28C′ are rather wide but shallow. Again, the sealed areas 28C and 28C′ do not cross the angle seal 15.

Since the handle material 18C may be too wide for comfortable gripping for carrying, there is here shown a plurality of openings 34 along the length of the handle material 18C. The openings 34 are here shown as circular, but it will be understood that any shape of openings may be provided to allow finger- or hand-holds for grasping the handle material 18C.

It will therefore be understood that the present invention provides a bottom gussetted plastic bag having a carrying strap, the carrying strap being sealed to the bag material by block seals so that a horizontal line is provided for distibution of the carrying force. The side panels of the completed bag carry the weight of the bag, and the side panels are carried by a wide area of handle material without concentration of forces. The handle material also lies snugly against the completed bag for a neat appearing package.

It will of course be understood by those skilled in the art that the particular embodiments of the invention here presented are by way of illustration only, and are meant to be no way restrictive; therefore, numerous changes and modifications may be made, and the full use of equivalents resorted to, without departing from the spirit or scope of the invention as outlined in the appended claims.

I claim:

1. A bag for receiving merchandise, wherein said merchandise has a generally rectangular form and urges said bag into said rectangular form, said bag including opposed side walls having a lower edge, an upper edge and two side edges, a bottom gusset between said side walls and attached to said lower edge of said side walls, a plurality of angle seals sealing each side of said bottom gusset to one side wall of said opposed side walls, a pair of side seams sealing said side edges of said side walls together and extending from said lower edge to said upper edge of said side walls, each of said angle seals extending substantially from one of said side seams to said lower edge of said side walls and defining a triangle at the corner of said bag, and a handle for said bag, said handle comprising a strip of handle material extending from one of said side seams to the opposite one of said side seams, said handle material being within said bottom gusset, and further including rectangular sealing means for fixing said handle material to said bottom gusset, said rectangular sealing means providing rectangular seals within said triagnles at the corners of said bag, the arrangement being such that said meachandise squares off said bag and a portion of said side walls forms end panels for said bag, said end panels being defined by said angle seals, and said rectangular seals are located within said end panels and are bisected by said side seams.

2. A bag as claimed in claim 1, said handle material comprising a strip of material folded along its centerline and having a folded edge, said bottom gusset having a folded edge centrally thereof and parallel to said lower edge of said side walls, said folded edge of said handle material being parallel to said folded edge of said bottom gusset and disposed between said side walls.

3. A bag as claimed in claim 2, said folded edge of said handle material being substantially contiguous with said folded edge of said bottom gusset.

4. A bag is claimed in claim 2, said rectangular seals extending generally from said lower edge of said side walls to said folded edge of said handle material.

5. A bag as claimed in claim 1, said sealing means comprising heat seals for welding said handle material to said gusset.

6. A bag as claimed in claim 2, said handle material defining a plurality of openings herein for providing holding means for said handle material.

7. A bag as claimed in claim 1, said sealing means comprising adhesive for fixing said handle material to said gusset.

8. A method for forming a handled bag of thermoplastic material, said bag being arranged for receiving generally rectangular contents to cause said bag to square off, said method including the steps of folding a strip of material on its longitudinal centerline for providing bag material having a folding edge and loose edges, folding said folded edge inwardly for providing a bottom gusset in said bag material, providing a plurality of angle seals in said bag material, each of said angle seals having a first side extending from the gussetted edge of said bag material inwardly to a line between adjacent bags and a second side extending from the gussetted edge of said bag material inwardly to said line between adjacent bags, and an apex at the junction of said first side and said second side, each of said angle seals sealing said gusset to said bag material, subsequently inserting a strip of handle material into said gusset, said handle material comprising a strip of material folded along its longitudinal centerline, and fixing said handle material to said gusset by attaching said handle material to said gusset with rectangular seals located between said first side and said second side of said angle seals, said rectangular seals being centered on said line between adjacent bags and confined within said angle seals.

9. A method as claimed in claim 8, wherein the step of inserting a strip of handle material into said gusset includes the steps of selecting handle material having a width less than the width of said gusset, and aligning the loose edges of said handle material with the edge of said bag material before the step of fixing said handle material to said gusset.

10. A method a claimed in claim 8, wherein the step of inserting a strip of handle material into said gusset includes the steps of selecting handle material having a width equal to the width of said gusset, and placing said handle material into said gusset in alignment with said gusset.

11. A method as claimed in claim 8, wherein the step of inserting a strip of handle material into said gusset includes the steps of placing said handle material within said gusset parallel to said gusset, spacing said fold in said handle material from the fold in said gusset, and allowing the loose edges of said handle material to extend beyond said bag material, and confining said rectangular seals to said bag material within said angle seal.

* * * * *